US007784785B2

(12) United States Patent
Böttger et al.

(10) Patent No.: US 7,784,785 B2
(45) Date of Patent: Aug. 31, 2010

(54) APPARATUS FOR FORMING SHEET STACKS AND DELIVERY OF A SHEET-FED ROTARY PRINTING MACHINE HAVING A STOP

(75) Inventors: Andreas Böttger, Heidelberg (DE); Andreas Detloff, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 548 days.

(21) Appl. No.: 11/388,452

(22) Filed: Mar. 24, 2006

(65) Prior Publication Data

US 2006/0214361 A1 Sep. 28, 2006

(30) Foreign Application Priority Data

Mar. 24, 2005 (DE) ..... 10 2005 013 652

(51) Int. Cl.
*B65H 31/36* (2006.01)

(52) U.S. Cl. ..... 271/221; 271/220

(58) Field of Classification Search ..... 271/220, 271/221, 222, 223
See application file for complete search history.

(56) References Cited

U.S. PATENT DOCUMENTS

| | | | | |
|---|---|---|---|---|
| 1,935,767 | A * | 11/1933 | Delany | 271/222 |
| 3,062,539 | A | 11/1962 | Obenshain | |
| 4,477,218 | A * | 10/1984 | Bean | 414/789.1 |
| 5,054,765 | A * | 10/1991 | Henn et al. | 271/213 |
| 5,188,353 | A * | 2/1993 | Parks | 271/184 |
| 5,374,051 | A * | 12/1994 | Ulrich et al. | 271/222 |
| 5,516,092 | A | 5/1996 | Pollich | |
| 5,709,382 | A * | 1/1998 | Shima | 271/209 |
| 5,890,713 | A | 4/1999 | Hofmann et al. | |
| 6,341,934 | B1 * | 1/2002 | Takeno et al. | 414/791.2 |
| 2002/0079642 | A1 * | 6/2002 | Tamura et al. | 271/207 |

FOREIGN PATENT DOCUMENTS

| | | | |
|---|---|---|---|
| DE | 43 22 561 | A1 | 1/1995 |
| DE | 196 27 241 | A1 | 6/1997 |
| EP | 0 575 718 | A1 | 12/1993 |
| FR | 540 427 | | 7/1922 |
| JP | 2002-179325 | | 6/2002 |
| JP | 2002-205865 | * | 7/2002 |

* cited by examiner

*Primary Examiner*—Saúl J Rodríguez
*Assistant Examiner*—Thomas A Morrison
(74) *Attorney, Agent, or Firm*—Laurence A Greenberg; Werner H Stemer; Ralph E Locher

(57) ABSTRACT

An apparatus for forming stacks in sheet-processing machines, in particular printing machines, includes side stops moving back and forth. The stops are divided into upper and lower parts. The lower part can be displaced vertically or in slotted guides and can interact with a switch in order to switch off a stack lift drive.

3 Claims, 5 Drawing Sheets

APPARATUS FOR FORMING SHEET STACKS AND DELIVERY OF A SHEET-FED ROTARY PRINTING MACHINE HAVING A STOP

BACKGROUND OF THE INVENTION

Field of the Invention

The invention relates to an apparatus for forming sheet stacks, having a stop for a side surface of the sheet stack. The invention also relates to a delivery of a sheet-fed rotary printing machine having the stop.

In sheet-processing machines, stops are provided which interact with a side surface of a sheet stack. In particular, in order to form sheet stacks, the stops can be driven back and forth at a cycle rate of the sheet-processing machine, for acting on the stack sides directed laterally with respect to a sheet transport direction.

Such an apparatus is disclosed by German Patent DE 43 22 561 C2, corresponding to U.S. Pat. No. 5,516,092. That apparatus has a generic straight sheet jogging apparatus, which is mounted in a side frame of a delivery of a sheet-fed printing machine in such a way that it can be tilted through small angles. The tilting movement can be registered by a switch and leads to a stack lifting device being switched off.

In order to set the stops to different processing formats, they are disposed in such a way that they can be moved. When processing small formats, the stops have to be moved relatively far in order to be able to interact with the stack. As a result, the lever arm is lengthened with respect to the tilting point, so that a relatively large deflection movement of the stop is needed in order to trigger the switch when making contact with the stack. In the worst possible case, the delayed switch triggering can lead to damage to parts of the delivery.

SUMMARY OF THE INVENTION

It is accordingly an object of the invention to provide an apparatus for forming sheet stacks and a delivery of a sheet-fed rotary printing machine having a stop, which overcome the hereinafore-mentioned disadvantages of the heretofore-known devices of this general type and which provide an adjustable stop in which triggering travel is the same with all formats.

With the foregoing and other objects in view there is provided, in accordance with the invention, an apparatus for forming stacks in a sheet-processing machine. The apparatus comprises a stop acting laterally on a sheet stack. The stop has a stop surface with at least upper and lower parts. According to one embodiment, the lower part is mounted for vertical displacement relative to the upper part. According to another embodiment, the lower part is mounted for displacement in common with the upper part, and the upper part is pivotable.

It is an advantage of the invention that damage to the straight sheet jogging apparatus as well as gripper bars disposed upstream of the sheet stack, is prevented. As a result of a telescopic construction of the stop with two stop parts disposed in such a way that they can be displaced into each other, or a tiltable mounting of the upper stop part, it is possible to place the stops very close underneath the gripper bars, in order to keep the drop height of the sheet from the grippers of the gripper bar until the start of the lateral guidance by the general joggers, as small as possible.

In accordance with a concomitant feature of the invention, the lower part is disposed in such a way that it can be displaced with respect to the upper part and, after a predefined switching travel, is displaced in parallel behind the upper part through the use of a slotted guide that is provided. As a result of this measure, the upper part can be disposed at a constant distance from the gripper bars.

Other features which are considered as characteristic for the invention are set forth in the appended claims.

Although the invention is illustrated and described herein as embodied in an apparatus for forming sheet stacks and a delivery of a sheet-fed rotary printing machine having a stop, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
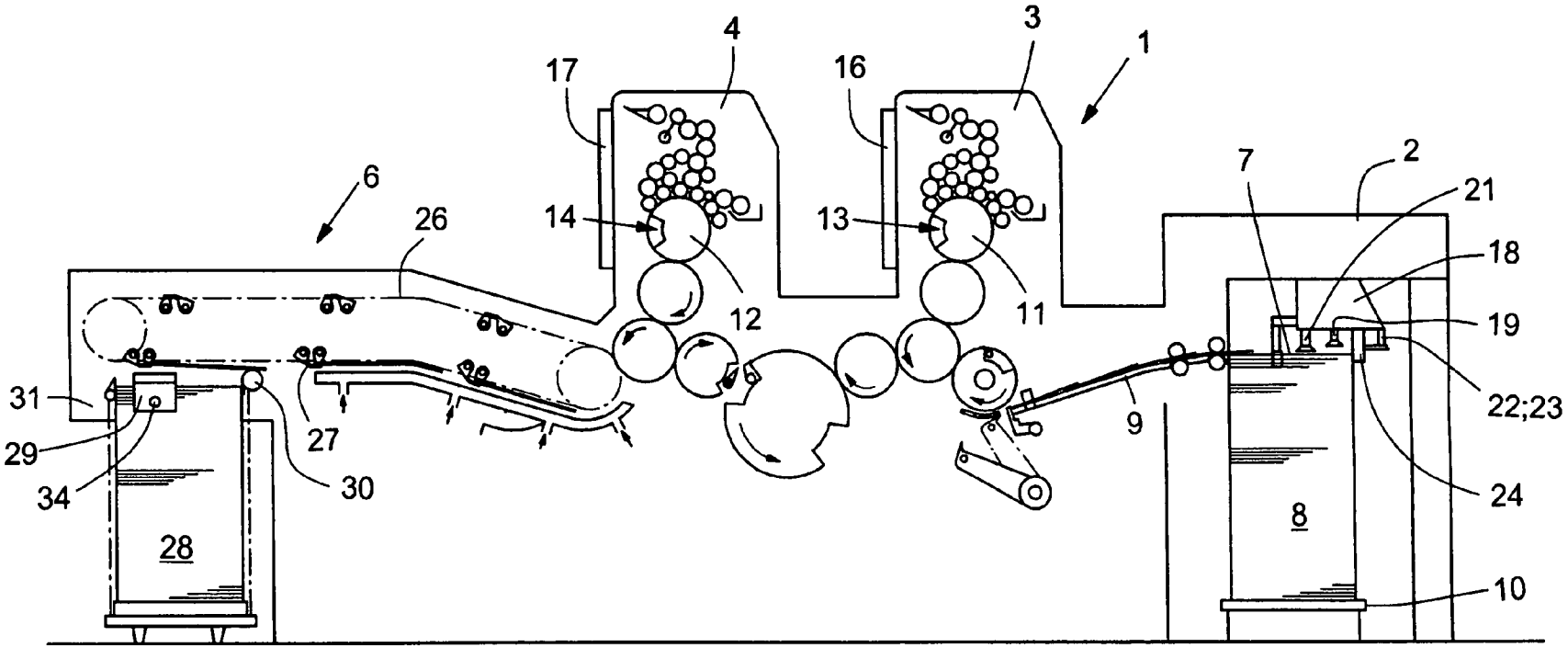
FIG. 1 is a diagrammatic, longitudinal-sectional view of a sheet-processing machine.

Referring now to the figures of the drawings in detail and first, particularly, to FIG. 1 thereof, there is seen a machine 1, for example a printing machine, for processing sheets 7. The printing machine 1 has a feeder 2, at least one printing unit 3, 4 and a delivery 6. The sheets 7 are removed from a sheet stack 8 and are fed, separated or overlapping, over a feed table 9 to the printing units 3, 4. The printing units 3, 4 each conventionally contain a plate cylinder 11, 12. The plate cylinders 11 and 12 each have a respective apparatus 13, 14 for fixing flexible printing plates. Furthermore, an apparatus 16, 17 for semiautomatic or fully automatic printing plate change is assigned to each respective plate cylinder 11, 12.

The sheet stack 8 lies on a stack board 10 which can be raised under control. The sheets 7 are removed from the top side of the sheet stack 8 through the use of a conventional suction head 18 which, inter alia, has a number of lifting and dragging suckers 19, 21 for the separation of the sheets 7. Furthermore, blowing devices 22 for loosening upper sheet layers and sensing elements 23 for tracking the stack are provided. A number of side and rear stops 24 are provided in order to align the sheet stack 8, in particular the upper sheets 7 of the sheet stack 8.

The delivery 6 has, among other things, a chain delivery system 26 having gripper bars 27 disposed at intervals transversely with respect to a sheet running direction. The gripper bars 27 hold the sheet firmly on at least one edge and deposit it on a sheet stack 28. A rear part of the sheet is braked through the use of a sheet brake 30. Side stops 29 are mounted in side frames 31, 32 (see FIG. 2 as well) and limit the sheets laterally in such a way that good stack formation is achieved. Each individual stop 29 is constructed as a straight sheet jogger, that is to say an actuator 34, for moving back and forth onto a sheet stack side 33 (seen in FIG. 2), moves the stop 29 transversely with respect to the sheet transport direction.

Figure 2:
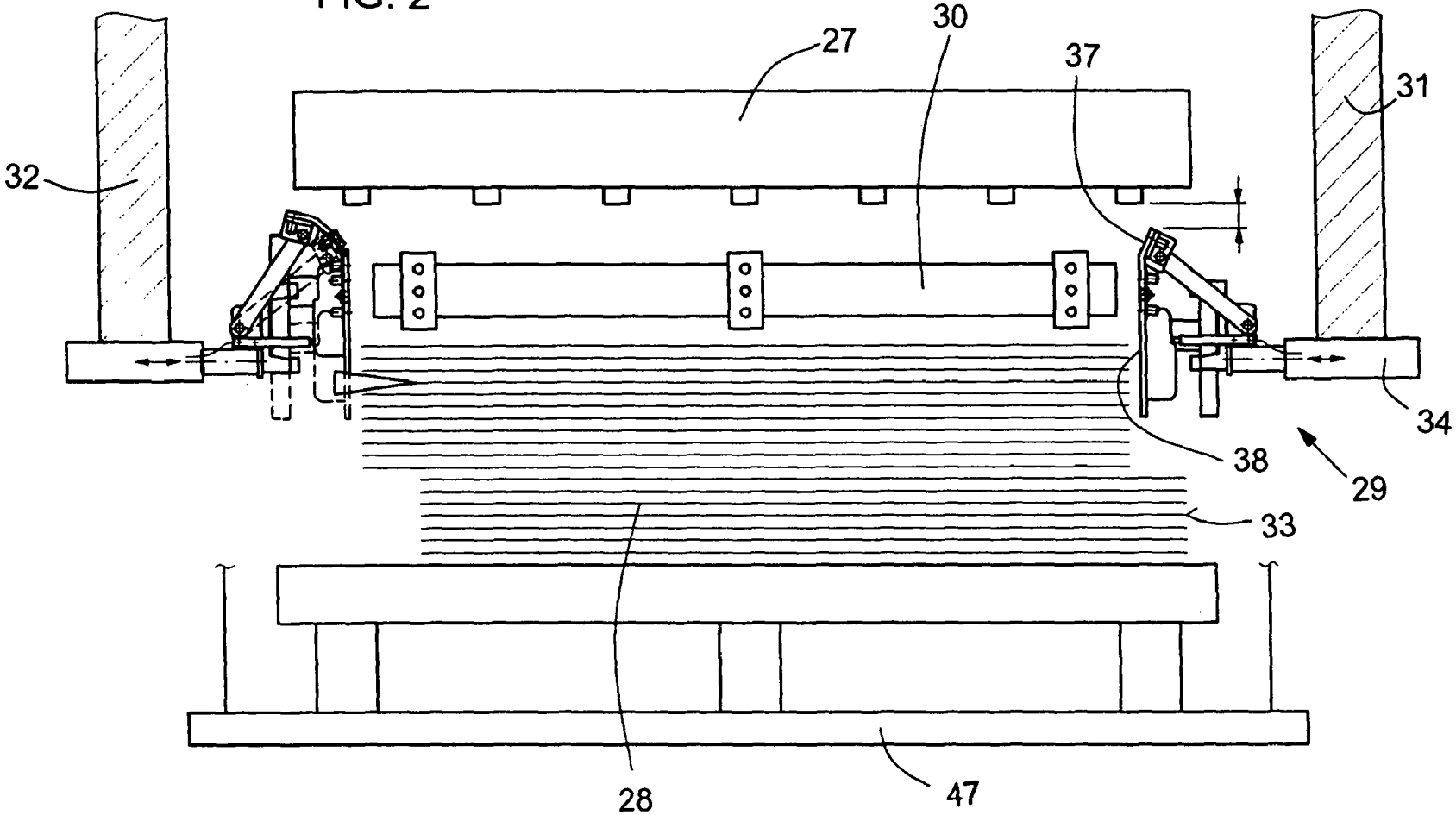
FIG. 2 is an enlarged, fragmentary, cross-sectional view of a sheet stack in a delivery, as seen from the rear.
Figure 4:
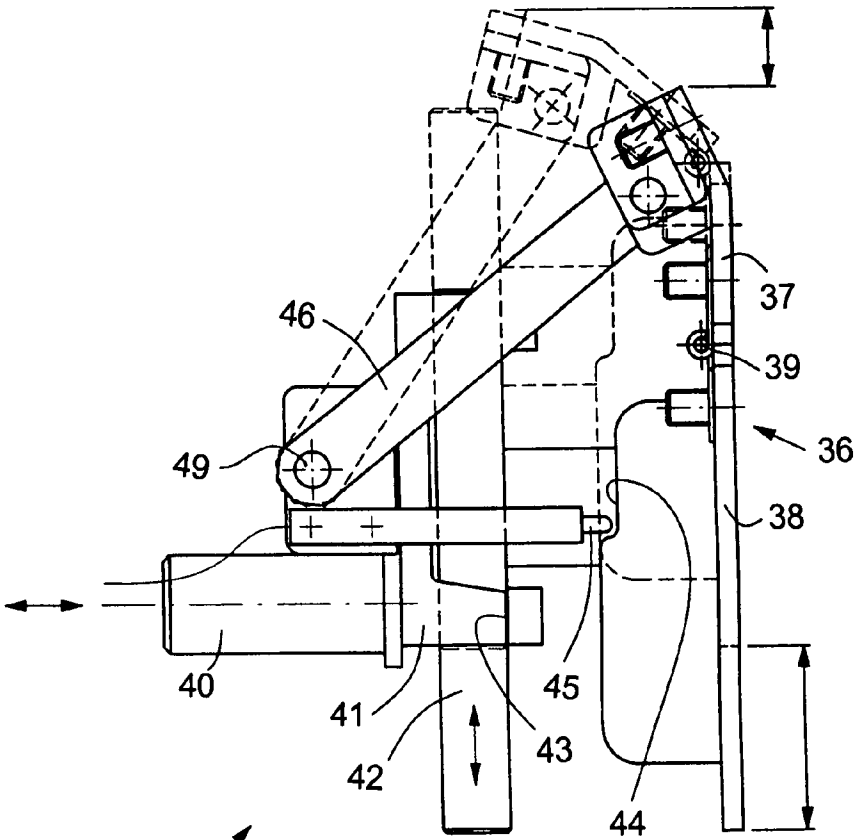
FIG. 4 is a side-elevational view of the stop of FIG. 3.
Figure 3:
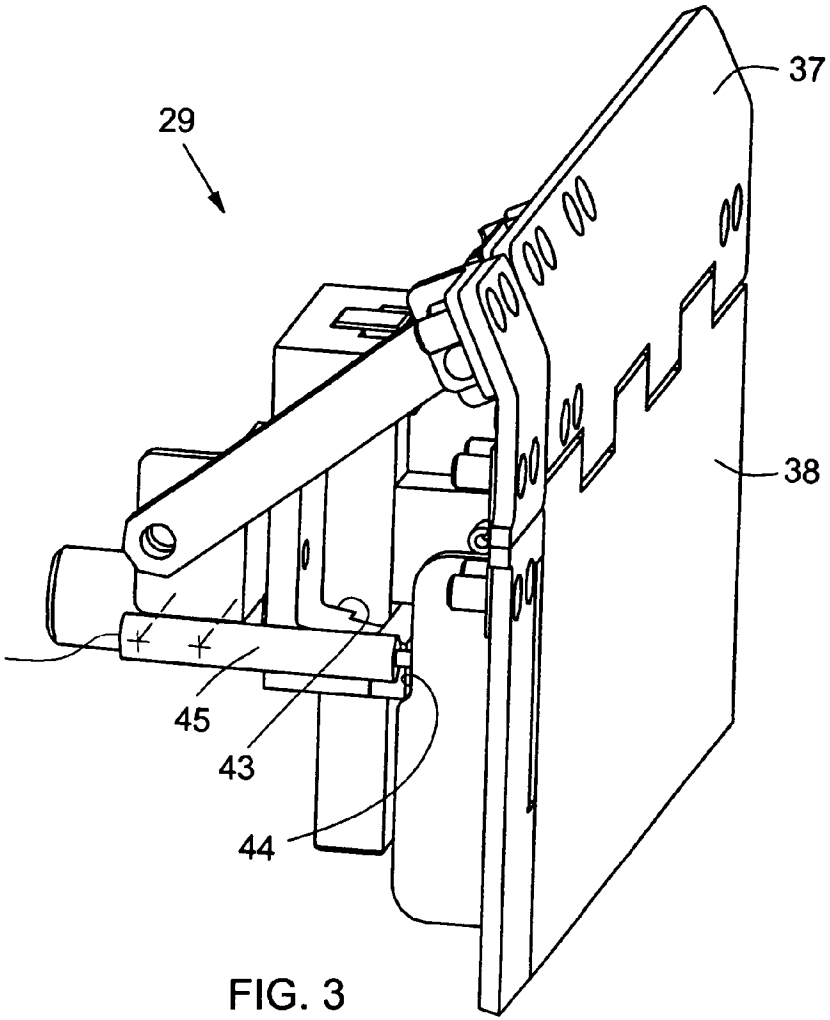
FIG. 3 is a further enlarged, perspective view of a first exemplary embodiment of a stop according to the invention.

As is seen in FIGS. 2, 3 and 4, in a first embodiment, the stop 29 substantially includes a two-part stop surface 36 having an upper part 37 and a lower part 38, which are connected to each other by a hinge joint 39. A holder 41 is fixed to the end of a rod 40 of the actuator 34 and carries the entire stop 29. The lower part 38 of the stop surface 36 is mounted through the use of a vertical guide rod 42 such that it can be displaced in a guide 43 of the holder 41. The lower part 38 carries a control cam 44, which interacts with a switch 45 disposed on the holder 41. The upper part 37 of the stop surface 36 is mounted on the holder 41 through the use of a coupler 46 such that it can pivot. When a stack board 47 or a feeder stack 28 mounted on the latter is raised, the rest of the stack or the stack board 47 itself can come into contact with the stops 29, in particular with the lower part 38. In this case, the lower part 38 will be raised and displaced vertically upward in the guide 43 of the holder 41, with the upper part 37 of the stop plate, connected to the lower part 38 through the use of the hinge joint 39, being pivoted about a hinge point 49 between the coupler 46 and the holder 41. The pivoting deflection movement is dimensioned in this case in such a way that a collision with the gripper bar 27 is ruled out. A switching region of the control cam 44 comes into contact with the switch 45 and switches off the drive for a stack lift.

Figure 5:
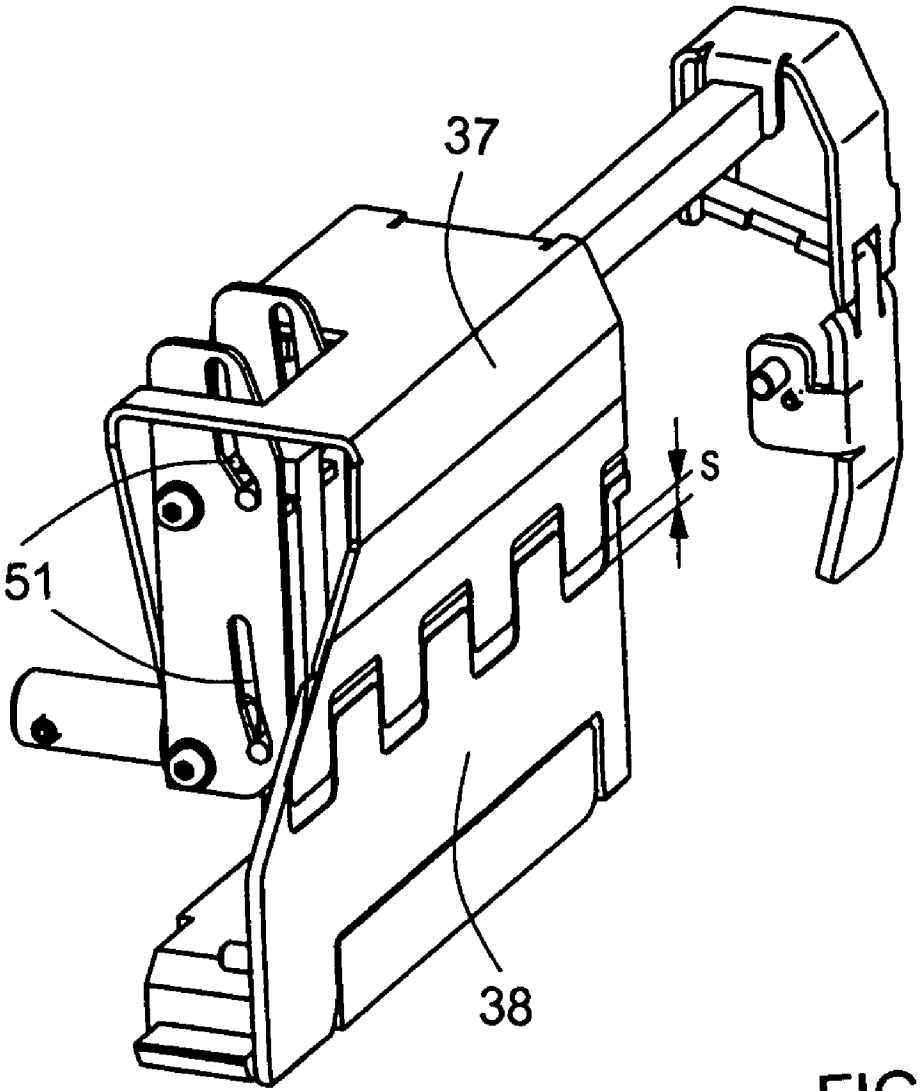
FIG. 5 is a perspective view of a second exemplary embodiment of the stop.

In a second exemplary embodiment according to FIG. 5, the upper part 37 is disposed fixedly on the holder 41, while the lower part 38 is mounted such that it can be displaced in a slotted guide 51 disposed on the holder 41. The slotted guide 51 is formed in such a way that the lower part 38, which forms the common vertical stop surface 36 along with the upper part 37, is at a distance s. When the lower part 38 is raised, the distance s is bridged and the switch 45 disposed on the holder 41 is actuated by the control cam 44 of the lower part 38, with the consequence that the stack lift drive is switched off.

In the event of being raised further, the lower part 38 is displaced behind the upper part 37 by the slotted guide 51 and thus out of the common stop plane. As a result of this measure, the moved parts are prevented from being able to enter into the region of the gripper bars 27 disposed above the stop 29.

The measure by which the upper part 37 and the lower part 38 of the stop plate have a comb-like, interengaging formation at their common edge, is particularly advantageous. In this way, during alignment operation, a gap-free stop surface 36 is produced, which prevents sheets from slipping through between the upper part 37 and the lower part 38.

Figure 7:
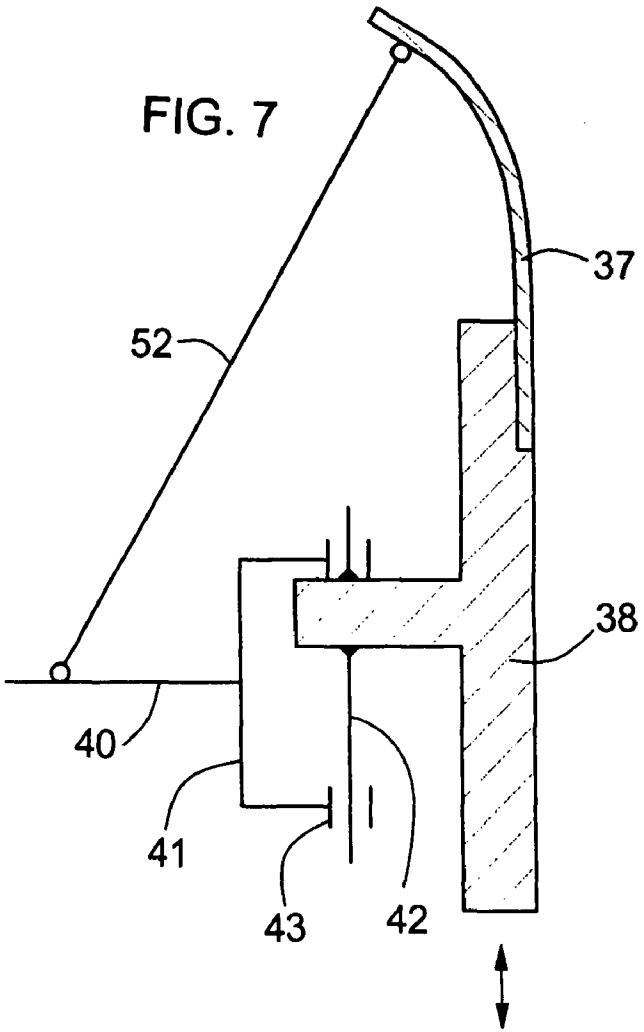
FIG. 7 is a sectional view of the third exemplary embodiment of the stop in a deflected position.
Figure 6:
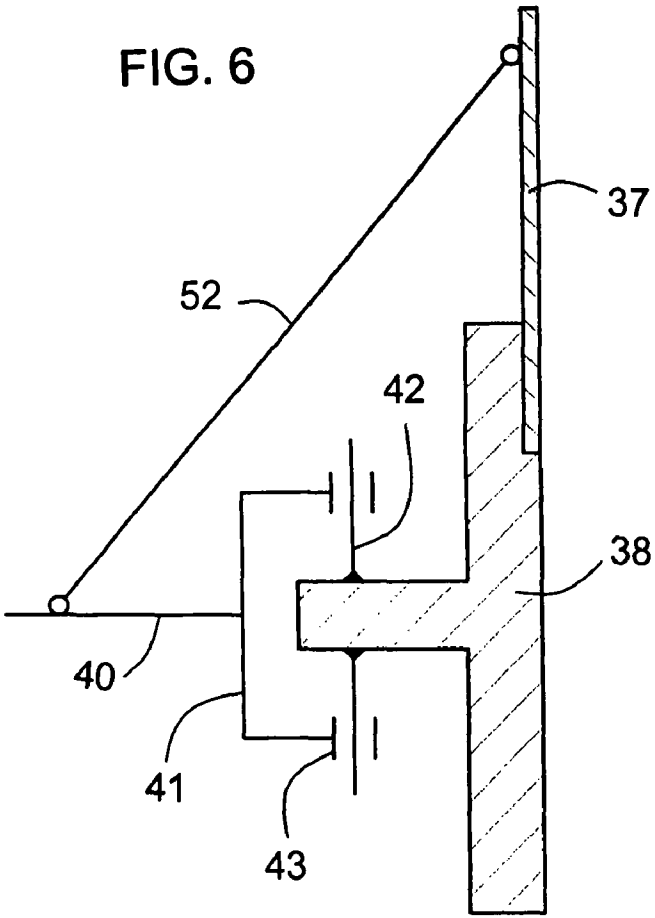
FIG. 6 is a sectional view of a third exemplary embodiment of the stop in a permanent position.

In a third exemplary embodiment according to FIGS. 6 and 7, provision is made to mount the lower part 38 of the stop surface 36 in such a way that it can be displaced, and to form the upper part 37 flexibly, for example from spring sheet metal. The upper part 37 and the lower part 38 are connected firmly to each other. The upper part 37 is connected to the rod 40 through a coupler or cord 52. Raising the lower part 38 and therefore the upper part 37 connected thereto leads to warping of the upper part 37, which means that vertical displacement of the upper part is prevented.

This application claims the priority, under 35 U.S.C. §119, of German Patent Application No. 10 2005 013 652.4, filed Mar. 24, 2005; the entire disclosure of the prior application is herewith incorporated by reference.

We claim:

1. An apparatus for forming stacks in a sheet-processing machine, the apparatus comprising:

an actuator;

a switch disposed on said actuator; and a stop being connected with said actuator for laterally moving said stop back and forth on a side of a sheet stack, said stop configured for being vertically displaceable with respect to said actuator by the stack or a by stack board supporting the stack, said stop having a stop surface with at least an upper part and a lower part, said lower part carrying a control cam for interacting with said switch during a vertical displacement of said stop, said lower part being mounted for displacement in common with said upper part, and said upper part being pivotable.

2. The apparatus according to claim 1, wherein said lower part is articulatedly connected to said upper part.

3. A delivery system of a sheet-fed rotary printing machine, the delivery system comprising:

a stop constructed and arranged according to claim 1.

* * * * *